US006135453A

United States Patent [19]

Srichayaporn

[11] Patent Number: 6,135,453

[45] Date of Patent: Oct. 24, 2000

[54] METHOD AND APPARATUS FOR PLAYING A HIGH/LOW POKER GAME

[76] Inventor: Songsak Srichayaporn, 886 W. Galveston St., #116, Chandler, Ariz. 85224

[21] Appl. No.: 09/139,553

[22] Filed: Aug. 25, 1998

[51] Int. Cl.[7] ..... A63F 1/00

[52] U.S. Cl. ..... 273/292; 273/303; 273/309; 273/294

[58] Field of Search ..... 273/303, 294, 273/292, 309

[56] References Cited

U.S. PATENT DOCUMENTS

| | | |
|---|---|---|
| 3,998,462 | 12/1976 | Goot . |
| 4,659,087 | 4/1987 | Shen et al. . |
| 5,255,915 | 10/1993 | Miller . |
| 5,288,081 | 2/1994 | Breeding . |
| 5,288,082 | 2/1994 | Marquez . |
| 5,294,128 | 3/1994 | Marquez . |
| 5,322,295 | 6/1994 | Cabot et al. . |
| 5,356,140 | 10/1994 | Dabrowski et al. . |
| 5,377,973 | 1/1995 | Jones et al. . |
| 5,382,025 | 1/1995 | Sklansky et al. . |
| 5,397,128 | 3/1995 | Hese . |
| 5,411,268 | 5/1995 | Nelson et al. . |
| 5,431,408 | 7/1995 | Adams . |
| 5,437,462 | 8/1995 | Breeding . |
| 5,452,899 | 9/1995 | Skratulia et al. . |
| 5,486,005 | 1/1996 | Neal . |
| 5,489,101 | 2/1996 | Moody . |
| 5,531,440 | 7/1996 | Dabrowski et al. . |
| 5,531,441 | 7/1996 | Dabrowski et al. . |
| 5,531,448 | 7/1996 | Moody . |
| 5,544,892 | 8/1996 | Breeding . |
| 5,573,249 | 11/1996 | Johnson . |
| 5,584,486 | 12/1996 | Franklin . |
| 5,632,487 | 5/1997 | Nguyen . |
| 5,692,755 | 12/1997 | Gutierrez . |
| 5,752,702 | 5/1998 | McDoniel . |
| 5,810,360 | 9/1998 | Srichayaporn . |
| 5,863,041 | 1/1999 | Boyan . |
| 5,863,042 | 1/1999 | Lo . |
| 5,868,392 | 2/1999 | Kraft . |
| 5,911,419 | 6/1999 | Delaney . |

*Primary Examiner*—Sebastiano Passaniti
*Assistant Examiner*—V K Mendiratta
*Attorney, Agent, or Firm*—Schmeiser, Olsen & Watts; Robert J. Mauri

[57] ABSTRACT

A method of playing a high/low poker game includes each seated player placing a first high hand wager in a first high hand betting location and a first low hand wager in a first low hand betting location; each seated player optionally placing one or more additional wagers in one or more additional high hand or low hand betting locations; each seated player designating at least two cards or tiles selected from an initial hand as a high hand and designating at least two cards or tiles from an initial hand as a low hand; determining winners and paying wagers for the first high hand and first low hand betting locations by comparing the relative rank of the seated players' high hands and low hands, respectively; and, if a seated player placed a wager in one or more additional high hand or low hand betting locations, then determining winners and paying wagers for each additional high hand betting location and each additional low hand betting location. A banking version of a high/low poker game additionally includes the step of a dealer setting out a dealer high hand and a dealer low hand to which the player's hands will be compared. In addition, an apparatus for playing a high/low poker game includes a playing area with at least two player stations designated to provide a high hand placement location; a low hand placement location; two or more high hand betting locations; and two or more low hand betting locations.

23 Claims, 3 Drawing Sheets

METHOD AND APPARATUS FOR PLAYING A HIGH/LOW POKER GAME

BACKGROUND OF THE INVENTION

1. Technical Field

This invention generally relates to the field of gaming and more specifically relates to a method of playing cards.

2. Background Art

The game of poker is one of the most popular card games played throughout the world. This game is typically played with a standard deck of playing cards containing fifty-two cards in four different suits. In another variation, Pai-Gow Tiles, a set of thirty-two tiles, somewhat similar to common domino tiles, are used in place of playing cards. The object of a standard game of "high" poker is for a player to collect a combination of cards or tiles in their hand having the highest rank relative to the other players' hands. Similarly, the object of the game of "low poker" is to collect a combination of cards or tiles having the lowest relative rank. The determination of what constitutes the highest or lowest ranking hand is based on a hierarchy of card or tile hands long established in poker and Pai-Gow. For example, in a five-card hand, the highest possible ranking hand is a "royal flush" including an Ace, King, Queen, Jack and Ten card all having the same suit (e.g., all diamonds). Similarly, in a five-card hand, the lowest possible ranking hand is a mixture including a Two, Three, Four, Five, and Six card having four different suits (e.g., diamonds, hearts, spades, and clubs). Thus, it can be seen that poker hands are ranked according to the hierarchy of the individual card or tile as well as the hierarchy of certain card combinations well known in the art.

Over the years, several variations of poker have been developed and become well established. One of these is high/low poker where the objective is to obtain either the highest ranking hand or the lowest ranking hand. Typically, high/low poker is played with a single hand and a player decides whether to attempt forming either the highest hand or the lowest hand. Many players prefer this type of poker because it doubles a player's chance of winning a portion of the "pot" or wagered amount. In a casino or gaming establishment setting, high/low poker is typically played at tables that include a location for a dealer and about six additional players. Each player places a bet and receives several cards. In order to win his bet, the cards in a player's hand must have a higher rank than the other players' high hands or a lower rank than the other players' low hands. A few variations of the standard high/low poker game have been developed. One of these variations is described in U.S. Pat. No. 5,294,128 to Marquez for a high/high/low banking card game. The patent is incorporated herein by reference for its pertinent and supportive teachings.

Although poker is a very popular card game, there are many areas of the country where poker cannot be played in regulated gaming establishments and casinos. For example, in Arizona, there are many gambling casinos that are operated on Federal Indian Reservations under the oversight of the National Indian Gaming Commission (NIGC). According to the current laws governing these gaming establishments, traditional poker and other "dealer bank" games may not be played because they are categorized as class III games under the Indian Gaming Regulatory Act (IGRA). In "dealer bank" games, the dealer or house acts as the bank, paying all losses and collecting all winnings from the other players at the table.

In view of this, it would be desirable to have a high/low poker game where the dealer did not operate as the bank, thereby creating a game that could be approved for use on Federal Indian Reservations. This would increase the revenue for the casinos and provide additional opportunities for gaming enjoyment for the patrons of the establishments. In addition, new and exciting variations of existing games are useful to stimulate interest and to attract new customers to casinos. While the basic high/low poker game can be enjoyable, alternate betting strategies would add variety and increased interest to game play.

In addition, without a constant influx of new and stimulating gaming options and opportunities, many casino customers have a tendency to lose interest in the casino and will generally seek entertainment elsewhere. Therefore, what is needed is a non-banking high/low poker game that can offer a variety of stimulating betting options and other variations to generate customer interest in the game and continued entertainment for the patrons of the casinos.

DISCLOSURE OF INVENTION

According to the present invention, a method of playing a high/low poker game is provided, including the steps of: a) each of two or more seated players placing a first high hand wager in a first high hand betting location and a first low hand wager in a first low hand betting location; b) each seated player optionally placing one or more additional wagers in one or more additional high hand or low hand betting locations; c) a dealer dealing an initial hand of at least four hierarchical indicators to each of the seated players; d) each seated player designating at least two hierarchical indicators selected from the initial hand as a high hand and designating at least two hierarchical indicators from the initial hand as a low hand; e) determining a winner or winners for the first high hand betting location by comparing the relative rank of the players' high hands, determining which of these hands is the highest rank, and declaring the players that have this hand as winners of the first high hand betting location; f) paying the wagers in the first hand betting location to the winner and, in the event of a tie, dividing the wagers among the winners; g) determining a winner or winners for the first low hand betting location by comparing the relative rank of the seated players' low hands determining which of these hands is the lowest rank, and declaring the players that have this hand as winners of the first low hand betting location; h) paying the wagers in the first low hand betting location to the winner and, in the event of a tie, dividing the wagers among the winners; and i) if at least one seated player placed a wager in one or more additional high hand or low hand betting locations, then determining winners and paying wagers for each additional high hand betting location and each additional low hand betting location.

Another method of playing a high/low poker game is provided, including the steps of: a) each of two or more seated players placing a first high hand wager in a first high hand betting location and a first low hand wager in a first low hand betting location; b) each seated player optionally placing one or more additional wagers in one or more additional high hand or low hand betting locations; c) a dealer dealing an initial hand of at least four hierarchical indicators to each of the seated players and setting out a dealer high hand and a dealer low hand; d) each seated player designating at least two hierarchical indicators selected from the initial hand as a high hand and designating at least two hierarchical indicators from the initial hand as a low hand; e) determining winners for the first high hand betting location by comparing the relative rank of each seated player's high hand to the dealer's high hand and selecting all seated players having higher ranking high hand; f) paying the wagers in the first high hand betting location to the winners from the dealer bank; g) determining winners for the first low hand betting location by comparing the relative rank of each seated player's low hand to the dealer's low hand and selecting all seated players having a lower ranking low hand; h) paying the wagers in the first low hand betting location to the winners from the dealer bank; and i) if at least one seated player placed a wager in one or more additional high hand or low hand betting locations, then determining winners and paying wagers for each additional high hand betting location and each additional low hand betting location.

By way of example in either or both of the two methods above, the two or more seated players may comprise two to eight seated players. Also, the hierarchical indicators may be selected from the group consisting essentially of cards, tiles, standard playing cards, and Pai-Gow tiles. Additionally, the one or more additional high hand or low hand betting locations may comprise two additional high hand and two additional low hand betting locations. Also for example, the initial hand may comprise seven cards, the high hand may comprise five cards, and the low hand may comprise two cards. Similarly, the initial hand may comprise four tiles, the high hand may comprise two tiles, and the low hand may comprise two tiles. Further, backline betting may be provided by each backline player placing one or more additional wagers in the one or more additional high hand or low hand betting locations that are not played by the two or more seated players. A backline player is a participating player that does not receive a hand, but may wager on a seated player's hands.

The foregoing and other features and advantages of the present invention will be apparent from the following more particular description of preferred embodiments of the invention, as illustrated in the accompanying drawings.

BRIEF DESCRIPTION OF DRAWINGS

Preferred embodiments of the present invention will hereinafter be described in conjunction with the appended drawings, where like designations denote like elements, and.

BEST MODE FOR CARRYING OUT THE INVENTION

Figure 1:
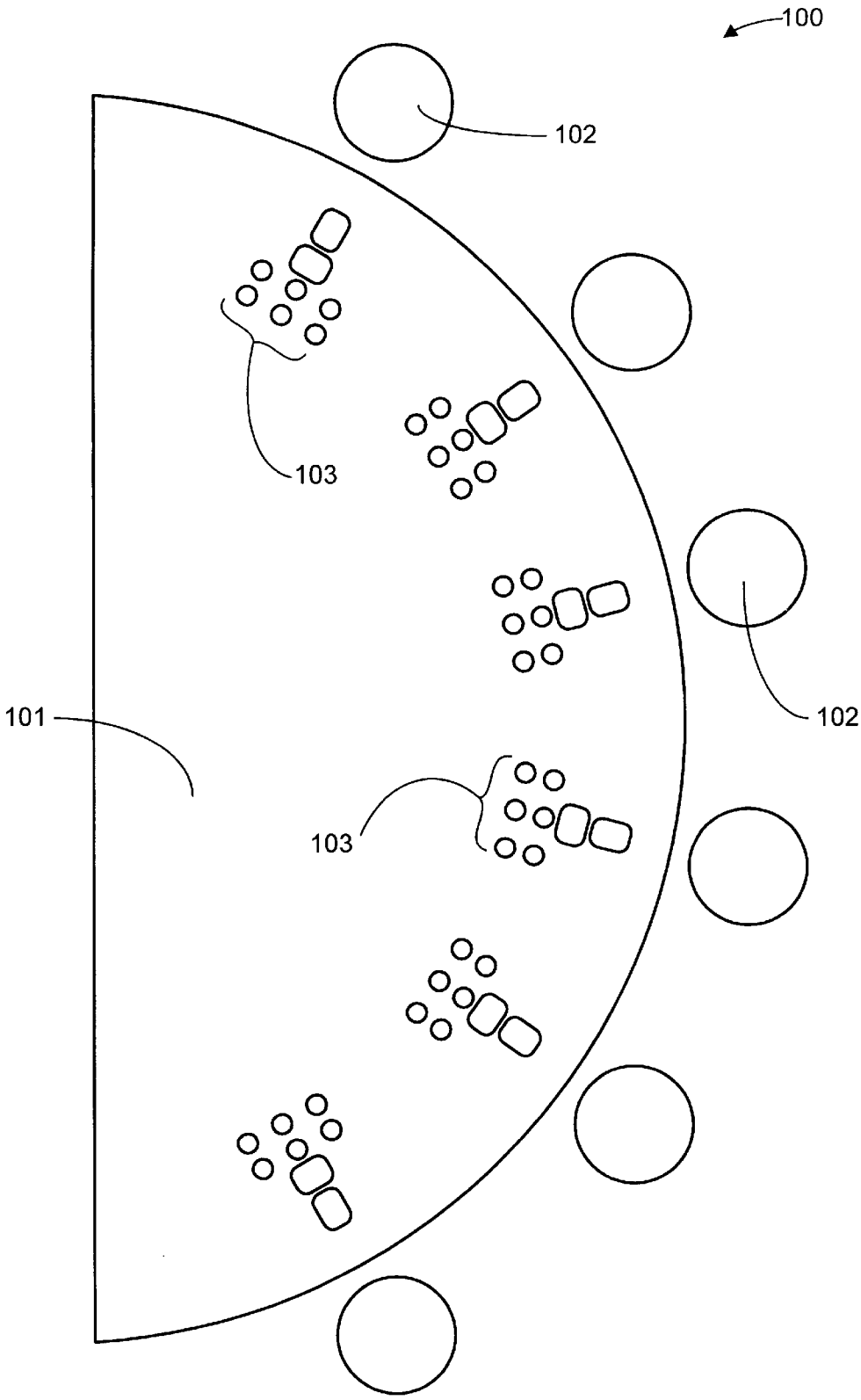
FIG. 1 is a top view of a table layout showing a playing area according to a preferred embodiment of the present invention.

A method of playing a high/low poker game is provided, essentially comprising the steps of the players making wagers, distributing hierarchical indicators, such as standard playing cards, Pai-Gow tiles, or other indicators, the players setting their hands, and the dealer determining winners. According to a preferred embodiment of the present invention, the method comprises the steps of: a) each of two or more seated players placing a first high hand wager in a first high hand betting location and a first low hand wager in a first low hand betting location; b) each seated player optionally placing one or more additional wagers in one or more additional high hand or low hand betting locations; c) a dealer dealing an initial hand of at least four hierarchical indicators to each of the seated players; d) each seated player designating at least two hierarchical indicators selected from the initial hand as a high hand and designating at least two hierarchical indicators from the initial hand as a low hand; e) determining winners for the first high hand betting location by comparing the relative rank of the seated players' high hands and selecting all seated players having a highest ranking high hand; f) paying the wagers in the first high hand betting location to the winner and, in the event of a tie, dividing the wagers among the winners; g) determining winners for the first low hand betting location by comparing the relative rank of the seated players' low hands and selecting all seated players having a lowest ranking low hand; h) paying the wagers in the first low hand betting location to the winner and, in the event of a tie, dividing the wagers among the winners; and i) if at least one seated player placed a wager in one or more additional high hand or low hand betting locations, then determining winners and paying wagers for each additional high hand betting location and each additional low hand betting location.

The above method describes a non-banking high/low poker game. In the alternative, another preferred embodiment of the present invention also provides a banking high/low poker game. In a banking version, the method comprises the steps of: a) each of two or more seated players placing a first high hand wager in a first high hand betting location and a first low hand wager in a first low hand betting location; b) each seated player optionally placing one or more additional wagers in one or more additional high hand or low hand betting locations; c) a dealer dealing an initial hand of at least four hierarchical indicators to each of the seated players and setting out a dealer high hand and a dealer low hand; d) each seated player designating at least two hierarchical indicators selected from the initial hand as a high hand and designating at least two hierarchical indicators from the initial hand as a low hand; e) determining winners for the first high hand betting location by comparing the relative rank of each seated player's high hand to the dealer's high hand and selecting all seated players having higher ranking high hand; f) paying the wagers in the first high hand betting location to the winners from the dealer bank; g) determining winners for the first low hand betting location by comparing the relative rank of each seated player's low hand to the dealer's high hand and selecting all seated players having a lower ranking low hand; h) paying the wagers in the first low hand betting location to the winners from the dealer bank; and i) if at least one seated player placed a wager in one or more additional high hand or low hand betting locations, then determining winners and paying wagers for each additional high hand betting location and each additional low hand betting location.

Understandably, there are several variations of the banking and non-banking methods described above that are within the scope of the present invention. A few variations according to preferred embodiments of the present invention are described below for both banking and non-banking methods. Preferably, the two or more seated players comprise two to eight seated players. Also, the hierarchical indicators include standard playing cards and Pai-Gow tiles as indicated above, but may also include a set of another type of card or tile that allows the playing of high/low poker according to the present invention. Accordingly, any set of cards or tiles may be used provided they have identifying markings and a system of hierarchy is designated such that hands of varying hierarchy will exist among players who are dealt the cards or tiles. Also, preferably the one or more additional high hand or low hand betting locations comprise two additional high hand and two additional low hand betting locations. If using a deck of fifty-two standard playing cards, then preferably the initial hand comprises seven cards, the high hand comprises five cards, and the low hand comprises two cards. If using a set of thirty-two Pai-Gow tiles, then preferably the initial hand comprises four tiles, the high hand comprises two tiles, and the low hand comprises two tiles. Other variations in the number of hierarchical indicators in the initial hand, high hand, and low hand are also within the scope of the present invention. Backline betting may also be incorporated into the methods above by adding the step of each backline player placing one or more additional wagers in the one or more additional high hand or low hand betting locations that are not played by the two or more seated players. A backline player is a participating player that does not receive a hand, but may wager on a seated player's hands.

In addition, a preferred embodiment of the present invention also includes an apparatus for playing a high/low poker game that provides a playing area with at least two player stations designated, wherein each of the at least two player stations comprises a) a high hand placement location; b) a low hand placement location; c) two or more high hand betting locations; and d) two or more low hand betting locations. More preferably, the apparatus includes three high hand betting locations, three low hand betting locations, and two to eight player stations.

Figure 2:
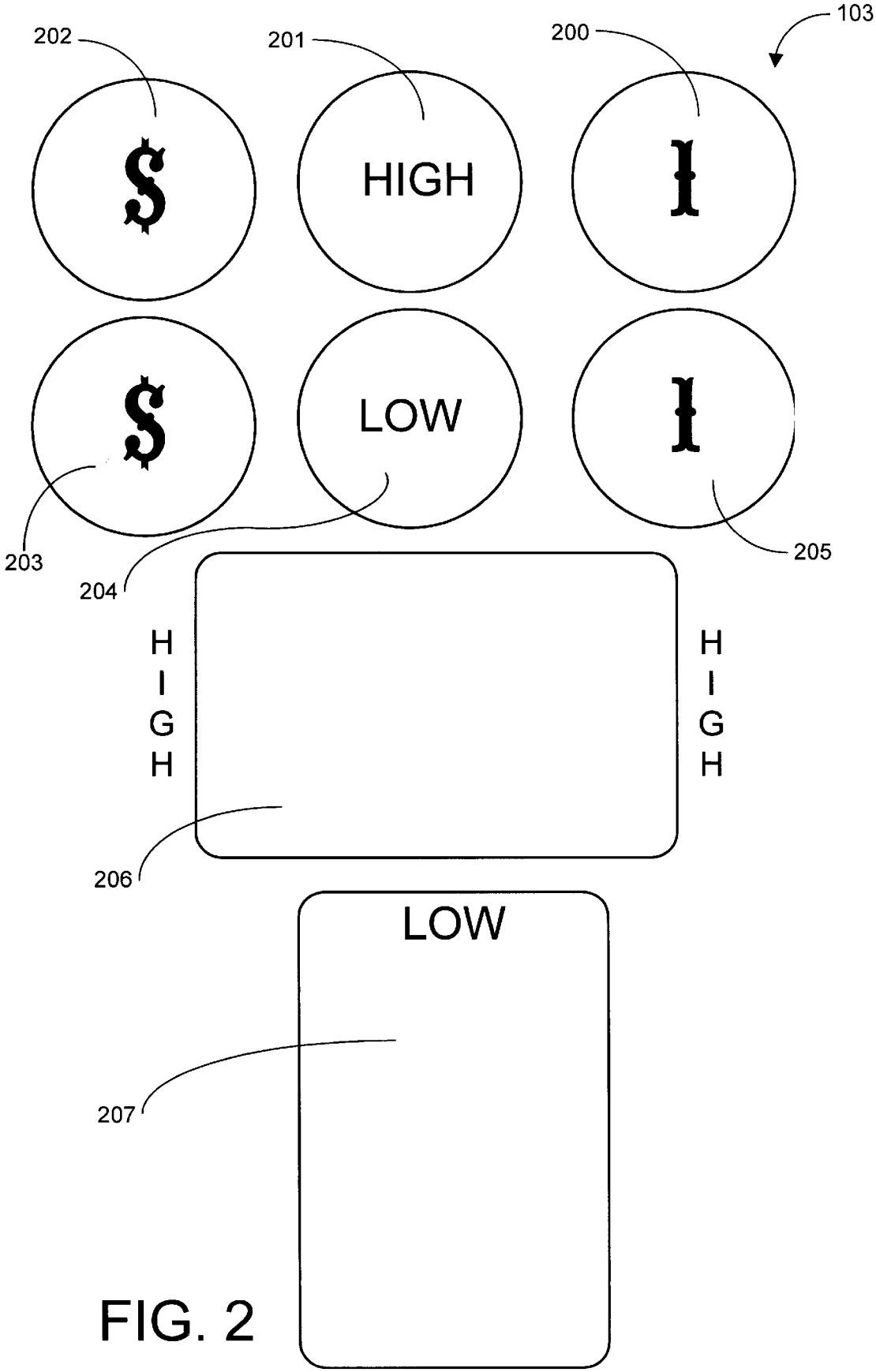
FIG. 2 is a top view of a player station from FIG. 1.
Figure 3:
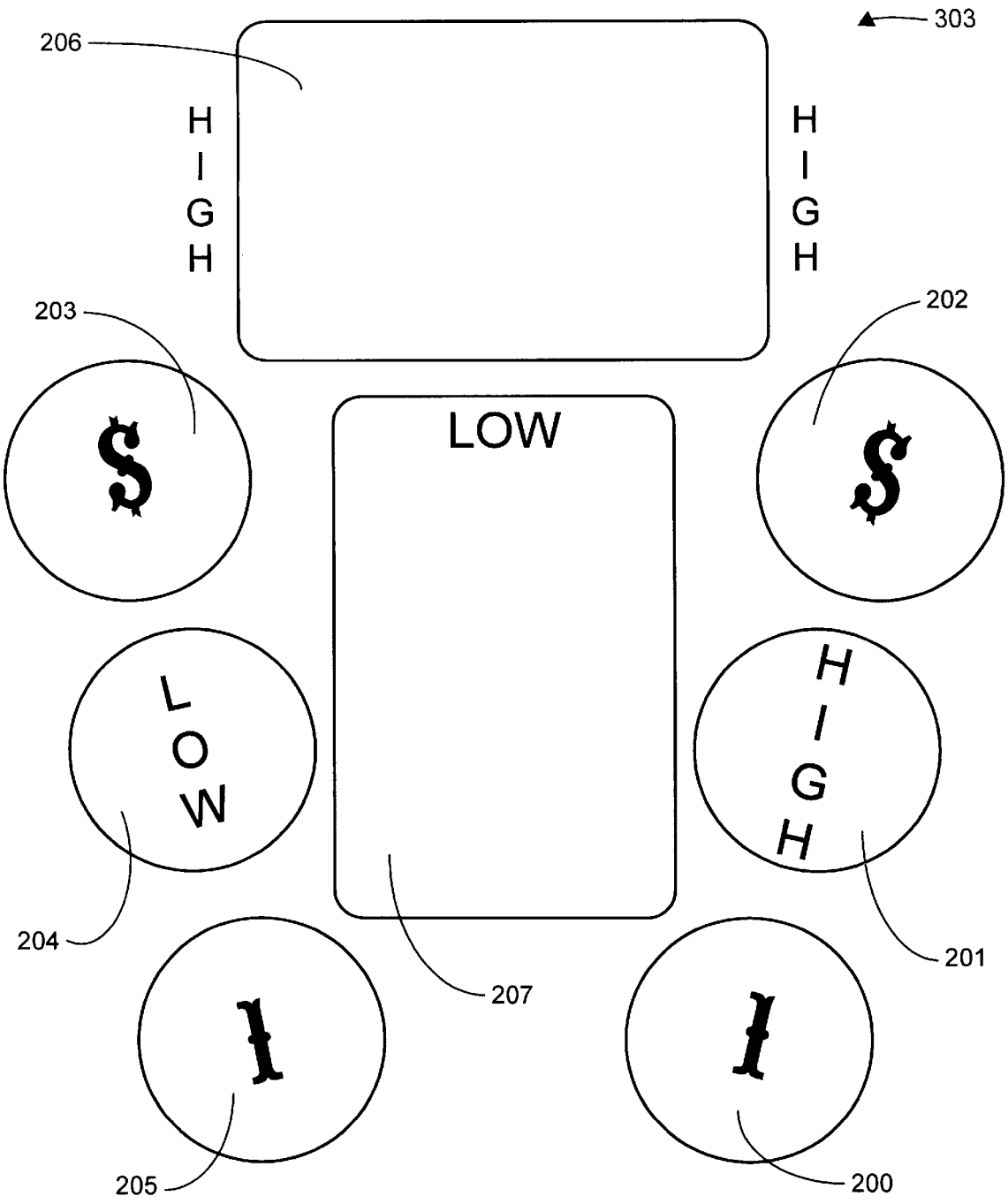
FIG. 3 is a top view of a player station according to another preferred embodiment of the present invention.

As shown in FIG. 1, an apparatus 10 for playing a high/low poker game may include a playing area 101 with seven player stations 103 designated, one for each seated player 102. Preferably, as shown in FIG. 2, each player station comprises a high hand placement location 206, a low hand placement location 207, a first high hand betting location 200, two additional high hand betting locations 201, 202, a first low hand betting location 205, and two additional low hand betting locations 204, 203. FIG. 3 shows an alternative positioning of the locations presented in FIG. 2, yielding an alternative player station 303. Notably, the same locations are present in FIG. 3 compared to FIG. 2, but they are rearranged to different positions. Understandably, other variations in position would also be within the scope of the present invention.

One example of a preferred method according to the present invention is presented below in the form of a set of game rules, house rules, dealing procedures, and hand ranking as might be set forth by a gaming establishment using the present invention. The description below is given by way of example, and not limitation. Variations set forth below may also be revised within the scope of the present invention to yield other methods in keeping with the basic methods described above.

EXAMPLE 1

Introduction

1. This is a poker style game utilizing a dealer button.

2. This can be a banking or non-banking card game. If the game is banked by the House or Player, Players play against the House or the Player banking the card game. Players banking the game are limited to two (2) banks per round!

3. This game offers the winning player up to six to one (6-1) odds on the amount each player wagers. These odds are only effective in a non-banking game!

4. The game is played with a standard deck consisting of fifty-two (52) cards, plus a Joker. The Joker can be represented in three (3) ways: Aces, Straights or Flushes. As an option, the Joker can be wild (any card). Aces can be played either high or low when making a player's hand.

5. Each player is dealt seven (7) cards. The object of the game is to create two (2) poker ranking hands. The front hands consist of two (2) cards (low hand) and the back hands consist of five (5) cards (high hand).

6. All players' front hands compete against all other players' front hands. All players' back hands compete against all other players' back hands.

7. The front hands from each player must be placed vertically in the low box and the back hands from each player must be placed horizontally in the high box. Once the cards are placed in their proper boxes, they may not be touched any further until the dealer begins exposing all hands, starting with the person in front of the button.

8. Cards removed from the table may be declared dead.

9. The casino will determine if backline betting is allowed (please see house rule number six (6)). If backline betting is allowed, in the event of a dispute over the setting of the hands, the player with the most money in action will make the final decision on how both hands are to be set. If it's determined that both players have equal bets, the seated player will make all final decisions on the placement of the cards.

10. The Floor Supervisor's decision is absolutely final!

Game Rules

1. All of the players compete against each other.

2. Up to seven (7) players are seated at the table.

3. Once the dealer announces, "No more bets (end of wagering)," players may not touch their bet(s) for any reason!

4. The game is played utilizing six (6) circles (three (3) circles in each high and low hands) as shown in FIG. 2. The first (1st) circle 201, 205 (in each high and low hand) requires a mandatory bet determined by the casino. The second (2nd) and third (3rd) circles 201, 202, 204, 203 in FIG. 2 are optional, with predetermined limits also determined by the casino.

5. Each player will be dealt or receive seven (7) cards. The object of the game is to create two (2) poker ranking hands. The front hand consist of two (2) cards (low hand) and the back hand consists of five (5) cards (high hand).

5A. When an action button and a dice cup is used, the following procedures will take place: The dealer will ask the player with the dealer button to select a pile in which to place the action button over. Then, the dealer will hand the same player the dice cup and ask him/her to shake the dice to determine the placement of the cards.

6. When all hands are set (completed), the dealer will announce "All hands set." Then, the dealer will start in front of the dealer button exposing all front hands first (low hands) to locate the winning hands for each circle. He/she will then pay off the winners. After retrieving the winning hands, he/she will repeat the same procedure when finding the winning high hands.

7. Players betting in the second circles 201, 204, and third circles 202, 203 will play their hands to its conclusion (both high and low hands).

8. The best hand for each circle wins and collects the pot for that circle. Pots for each circle may be divided in the event of ties. Alternatively, the winner for each circle will only collect the amount of the winner's wager from each loser's circle. For example, if the winner only bet a $10 chip, then the winner may only collect a maximum of a $10 chip from each loser's circle, even though the loser may have wagered a higher amount.

9. All payoffs can be paid starting from either the first or third circles.

10. The dealer button will always move forward after each hand to the next player.

House Rules (without backline betting)

1. The game is played with a standard fifty-two (52) card deck plus a Joker.

2. The game is played with a dealer button.

3. The house collection or ante is determined by the casino.

4. No cash bets are allowed. All bets must be played in chips.

5. Each table and each betting circle has a spread limit defining the minimum and maximum amount that may be wagered in each spot. Players must wager at least the table minimum.

If a player bets less than the table minimum required (for each circle), he/she will receive action only on their bet(s) they placed. The remaining players will receive their money back for the incorrect wager wagered by the winner. Any amount wagered over the maximum will receive no action!

6. Backline betting is not allowed!

7. During the deal, if there's one boxed or exposed card dealt, the dealer will continue to deal. When the dealer completes his deal, the boxed or exposed card will be replaced with the top card from the stub. If an Ace or Joker is boxed or exposed, it will be declared a misdeal. If any two (2) cards are dealt face up, it will be declared a misdeal.

8. If a player exposes his/her own cards, the hand must play!

9. When the dealer starts exposing the first hand and notices one player with his hand not set, the dealer will immediately call for a supervisor. The supervisor will close the exposed hand first. That supervisor will call another supervisor to set the player's hand that wasn't set upon the exposure of the first player's cards.

10. A player removing a winning wager from the betting circles may be paid the minimum bet if the correct amount of the wager cannot be determined.

11. A player removing a losing wager from the betting circles may be barred!

12. The contents of each hand must be kept secret. During play of each hand, only English may be spoken.

13. Management reserves the right to make decisions which are in the best interest of the game. Therefore, under special circumstances, a decision may be rendered that is contrary to the strict and technical interpretation of these rules.

House Rules (with backline betting)

1. The game is played with a standard fifty-two (52) card deck plus a Joker.

2. The game is played with a dealer button.

3. The house collection or ante is determined by the casino.

4. No cash bets are allowed. All bets must be played in chips.

5. Each table and each betting circle has a spread limit defining the minimum and maximum amount that may be wagered in each spot. Players must wager at least the house minimum.

If a player bets less than the table minimum required (for each circle), he/she will receive action only on their bet(s) they placed. The remaining players will receive their money back for the incorrect wager wagered by the winner. Any amount wagered over the maximum will receive no action!

6. Backline betting is allowed in addition to the player's wagers. A seated player may not refuse wagering on a position they are not playing. In the event of a dispute over the play of a hand, the player with the most money in action will make the final decision whether to hit or stand. If it's determined that both players have equal bets, the seated player will make all final decisions on the placement of the cards.

7. During the deal, if there's one boxed or exposed card dealt, the dealer win continue to deal. When the dealer completes his deal, the boxed or exposed card will be replaced with the top card from the stub. If an Ace or Joker is boxed or exposed during the deal, it will be declared a misdeal. If any two (2) cards are exposed during the deal, it will be declared a misdeal.

8. If a player exposes his/her own cards, the hand must play!

9. When the dealer starts exposing the first hand and notices one player with his hand not set, the dealer will immediately call for a supervisor. The supervisor will close the exposed hand first. That supervisor will call another supervisor to set the player's hand that wasn't set upon the exposure of the first player's cards.

10. A player removing a winning wager from the betting circles maybe paid the minimum bet if the correct amount of the wager cannot be determined.

11. A player removing a losing wager from the betting circles may be barred.

12. The contents of each hand must be kept secret. During play of each hand, only English may be spoken.

13. Management reserves the right to make decisions which are in the best interest of the game. Therefore, under special circumstances, a decision may be rendered that is contrary to the strict and technical interpretation of these rules.

Dealing Procedures (Thumbing down the cards in front of the dealer tray)

1. STARTING A NEW GAME:

The dealer will spread and check both decks to insure that each deck is complete. Then, the dealer will place the dealer button in front of seat one. The house dealer will shake the dice cup to determine the placement of the dealer button.

2. SHUFFLING PROCEDURE:

The dealer will scramble and shuffle the deck to be used. He/she will then shuffle, shuffle, box and shuffle while asking the players to place their bets.

3. CUTTING PROCEDURE:

The dealer will present the deck to the player with the dealer button and offer him/her to cut the deck. The dealer will place the cut card in front of the deck. The player win cut the deck forward, using one (1) hand only, and the house dealer will finish the cut.

4. THE DEALING OF THE CARDS:

A. The dealer will carefully thumb down seven (7) cards in front of his/her tray starting from left to right and reversing this procedure six (6) more times until each pile has seven cards total. There should be four (4) cards remaining.

B. During the deal, if one (1) boxed card or one (1) exposed card exists, the dealer win continue to deal. When the dealer completes his/her deal, the boxed card or the exposed card will be replaced with the top card from the stub.

C. If an two (2) cards are exposed, it will be declared a misdeal.

D. If the boxed or exposed card is an Ace or a Joker, it will be declared a misdeal.

E. If a player exposes his/her own cards, the hand must play!

5. THE READING OF THE DICE:

The position of the player with the dealer button is either one (1), eight (8) or fifteen (15). That is, if the dice total is three (3) to seven (7), then the dealer button is at position one (1) and moves clockwise by counting positions to the position designated by the dice total. If the dice total is eight (8) to fourteen (14), then the dealer button is at position eight (8) and if the dice total is fifteen (15) or greater, then the dealer button is at position fifteen (15).

6. THE DELIVERING OF THE CARDS:

The dealer will ask the player with the dealer button to select a pile in which to place the action button over. Then, the dealer will hand the same player the dice cup and ask him/her to shake the dice to determine the placement of the cards. The cards are also delivered clockwise, starting from the action button. Before the dealer opens the dice cup, the dealer will announce, "No more bets." After the cards are delivered to each player, the dealer will shake the dice cup and put it back in his/her tray.

7. THE SETTING OF THE HANDS:

When all the players place their cards in the proper boxes, the dealer will announce, "All hands set."

8. THE EXPOSING OF A HAND TOO SOON:

When the dealer starts exposing the first hand and notices one player with his hand not set, the dealer will immediately call for a supervisor. The supervisor will close the exposed hand first. That supervisor will call another supervisor to set the player's hand that wasn't set upon the exposure of the first player's cards.

9. LOCATING THE WINNER: The dealer will start exposing the front hands (low hands), starting from the left of the dealer button to locate the winning hand(s) for each circle. The dealer will then pay off the winners. He/she will then place all low hand cards into the muck and proceed to reading the back hands (high hands), starting again from the left of the dealer button. The dealer will follow the same procedures (as when reading the low hands) to find the best high hand(s).

10. PAYOFFS:

All payoffs can be paid starting from either the first (1st) or third (3rd) circles.

11. COLLECTION DROP:

After the high hand(s) are paid, the dealer will kill the winning hand(s) and drop the house collection. Then, the dealer will move the dealer button to the next player.

12. NEW DEALER RELIEVING PREVIOUS DEALER:

When the next dealer comes to relieve (push) the dealer in the box, the dealer crosses the deck that was used and places it in front of his/her tray. They will then bring out the second deck and spread them face down in a semi-circle position.

13. CARD CHANGING PROCEDURE:

The dealer must deal at least one (1) round or close to seven (7) hands before a customer can request a deck change.

LOW HAND RANKING

1. An Ace with a Joker. Joker is a Deuce.
2. Ace-2
3. Ace-3
4. 2-3
5. Ace-4
6. 2-4
7. 3-4
8. Ace-5
9. 2-5
10. 3-5
11. 4-5
12. Ace-6
13. 2-6

BAD BEAT JACKPOT

A player with a hand of Aces Full that is beat by four (4) of a kind or better will receive a portion of the jackpot as determined by the casino.

BONUS HANDS

As determined by the casino, bonuses in predetermined amounts may be awarded to a player with a hand of Five (5) Aces, Royal Flush without Joker, Royal Flush with Joker, any Straight Flush without Joker, any Straight Flush with Joker, any four (4) of a kind.

While the invention has been particularly shown and described with reference to preferred embodiments thereof, it will be understood by those skilled in the art that various changes in form and details may be made therein without departing from the spirit and scope of the invention. Accordingly, unless otherwise specified, any dimensions of the apparatus indicated in the drawings or herein are given as an example of possible dimensions and not as a limitation. Similarly, unless otherwise specified, any sequence of steps of the method indicated in the drawings or herein are given as an example of a possible sequence and not as a limitation.

What is claimed is:

1. A method of playing a high/low poker game, the method comprising the steps of:

a) each of two or more players placing a first high hand wager in a first high hand betting location and a first low hand wager in a first low hand betting location;

b) each of the players optionally placing one or more additional wagers in one or more additional high hand or low hand betting locations;

c) a dealer dealing an initial hand of at least four hierarchical indicators to each of the players;

d) each of the players designating at least two hierarchical indicators selected from the initial hand as a high hand and designating at least two hierarchical indicators from the initial hand as a low hand;

e) determining a first high hand or first high hand winners for the first high hand betting location by:

I) comparing the relative rank of the players' high hands;

II) determining the highest ranking hand of the players' high hands; and

III) declaring each of the players having the highest ranking hand a first high hand winner;

f) paying the wagers in the first high hand betting location to the first high hand winner and, in the event of a tie, dividing the wagers in the first high hand betting location among the first high hand winners;

g) determining winners for the first low hand betting location by:

I) comparing the relative rank of the players' low hands;

II) determining the lowest ranking hand of the players' low hands; and

III) declaring each of the players having the lowest ranking hand a first low hand winner;

h) paying the wagers in the first low hand betting location to the first low hand winner and, in the event of a tie, dividing the wagers in the first low hand betting location among the first low hand winners; and i) if at least one seated player placed a wager in one or more additional high hand or low hand betting locations, then determining winners and paying wagers for each additional high hand betting location and each additional low hand betting location.

2. The method of claim 1, wherein the two or more players comprise two to eight players.

3. The method of claim 1, wherein the hierarchical indicators are selected from the group consisting essentially of cards, tiles, standard playing cards, and Pai-Gow tiles.

4. The method of claim 1, wherein the one or more additional high hand or low hand betting locations comprises two additional high hand and two additional low hand betting locations.

5. The method of claim 1, wherein the initial hand comprises seven cards, the high hand comprises five cards, and the low hand comprises two cards.

6. The method of claim 1, wherein the initial hand comprises four tiles, the high hand comprises two tiles, and the low hand comprises two tiles.

7. The method of claim 1, additionally comprising the step of each backline player placing one or more additional wagers in the one or more additional high hand or low hand betting locations that are not played by the two or more players.

8. A method of playing a high/low poker game, the method comprising the steps of:

a) each of two or more players placing a first high hand wager in a first high hand betting location and a first low hand wager in a first low hand betting location, wherein the first high hand wager and first low hand wager made by each player may be different;

b) each seated player optionally placing one or more additional wagers in one or more additional high hand or low hand betting locations;

c) a dealer dealing an initial hand of at least four hierarchical indicators to each of the players and setting out a dealer high hand and a dealer low hand;

d) each seated player designating at least two hierarchical indicators selected from the initial hand as a high hand and designating at least two hierarchical indicators from the initial hand as a low hand;

e) determining winners for the first high hand betting location by:

I) comparing the relative rank of each player's high hand to the dealer's high hand;

II) determining the highest ranking hand of the players' high hands; and

III) declaring each of the players having a hand that ranks higher than the dealer's high hand a first high hand winner;

f) paying to one of the first high hand winners an amount equivalent to the one first high hand winner's first high hand wager, and continuing the step of paying to one of the first high hand winners until each of the first high hand winners has been paid;

g) determining winners for the first low hand betting location by:

I) comparing the relative rank of each seated player's low hand to the dealer's low hand;

II) determining the lowest ranking hand of the players' low hands; and

III) declaring each of the players having a hand that ranks lower than the dealer's low hand a first low hand winner;

h) paying to one of the first low hand winners an amount equivalent to the one first low hand winner's first low hand wager, and continuing the step of paying to one of the first low hand winners until each of the first low hand winners has been paid; and i) if at least one seated player placed a wager in one or more additional high hand or low hand betting locations, then determining winners and paying wagers for each additional high hand betting location and each additional low hand betting location.

9. The method of claim 8, wherein the two or more players comprise two to eight players.

10. The method of claim 8, wherein the hierarchical indicators are selected from the group consisting essentially of cards, tiles, standard playing cards, and Pai-Gow tiles.

11. The method of claim 8, wherein the one or more additional high hand or low hand betting locations comprises two additional high hand and two additional low hand betting locations.

12. The method of claim 8, wherein the initial hand comprises seven cards, the high hand comprises five cards, and the low hand comprises two cards.

13. The method of claim 8, wherein the initial hand comprises four tiles, the high hand comprises two tiles, and the low hand comprises two tiles.

14. The method of claim 8, additionally comprising the step of each backline player placing one or more additional wagers in the one or more additional high hand or low hand betting locations that are not played by the two or more players.

15. The method of claim 1 wherein the step of declaring each of the players having the highest ranking hand a first high hand winner and the step of declaring each of the players having the lowest ranking hand a first low hand winner are independent.

16. The method of claim 1 wherein the hierarchical indicators are at least one deck of standard playing cards and at least one joker, wherein the at least one joker may be used to represent an ace, to complete a straight or a flush, or to represent any card.

17. The method of claim 1 wherein the step of if at least one seated player placed a wager in one or more additional high hand or low hand betting locations, then determining winners and paying wagers for each additional high hand betting location and each additional low hand betting location comprises the steps of:

I) performing the following steps for each additional high hand betting location:

A) selecting one of the additional high hand betting locations;

B) determining a winner or winners for this selected high hand betting location by:

1) comparing the relative rank of the players' high hands;

2) determining the highest ranking hand of the players' high hands; and 3) declaring each of the players having the highest ranking hand a winner of the selected high hand betting location; and C) paying the wagers in the selected high hand betting location to the winner of the selected high hand betting location and, in the event of a tie, dividing the wagers in the selected high hand betting location among the winners of the selected high hand betting location; and II) performing the following steps for each additional low hand betting location:

A) selecting one of the additional low hand betting locations;

B) determining a winner or winners for the selected low hand betting location by:

1) comparing the relative rank of the players' low hands;

2) determining the lowest ranking hand of the players' low hands; and 3) declaring each of the players having the lowest ranking hand a winner of the selected low hand betting location; and C) paying the wagers in the selected low hand betting location to the winner of the selected low hand betting location and, in the event of a tie, dividing the wagers in the selected low hand betting location among the winners of the selected low hand betting location.

18. The method of claim 1 wherein the first high hand betting location comprises a plurality of first high hand betting locations, each of the plurality of first high hand betting locations corresponding to one of the players, and wherein the first low hand betting location comprises a plurality of first low hand betting locations, each of the plurality of first low hand betting locations corresponding to one of the players.

19. The method of claim 1 wherein the first high hand wager and first low hand wager made by each player may be different.

20. The method of claim 8 wherein the step of declaring each of the players having a hand that ranks higher than the dealer's high hand a first high hand winner and the step of declaring each of the players having a hand that ranks lower than the dealer's low hand a first low hand winner are independent.

21. The method of claim 8 wherein the hierarchical indicators are at least one deck of standard playing cards and at least one joker, wherein the at least one joker may be used to represent an ace, to complete a straight or a flush, or to represent any card.

22. The method of claim 8 wherein the step of if at least one seated player placed a wager in one or more additional high hand or low hand betting locations, then determining winners and paying wagers for each additional high hand betting location and each additional low hand betting location comprises the steps of:

I) performing the following steps for each additional high hand betting location:

A) selecting one of the additional high hand betting locations;

B) determining a winner or winners for the selected high hand betting location by:

1) comparing the relative rank of each player's high hand to the dealer's high hand;

2) determining the highest ranking hand of the players' high hands; and 3) declaring each of the players having a hand that ranks higher than the dealer's high hand a winner of the selected high hand betting location; and C) paying to one of the winners of the selected high hand betting location an amount equivalent to the high hand wager placed in the selected high hand betting location by the one winner of the selected high hand betting location, and continuing the step of paying to one of the winners of the selected high hand betting location until each of the winners of the selected high hand betting location has been paid; and II) performing the following steps for each additional low hand betting location:

A) selecting one of the additional low hand betting locations;

B) determining a winner or winners for the selected low hand betting location by:

1) comparing the relative rank of each player's low hand to the dealer's low hand;

2) determining the lowest ranking hand of the players' low hands; and 3) declaring each of the players having a hand that ranks lower than the dealer's low hand a winner of the selected low hand betting location; and C) paying to one of the winners of the selected low hand betting location an amount equivalent to the low hand wager placed in the selected low hand betting location by the one winner of the selected low hand betting location, and continuing the step of paying to one of the winners of the selected low hand betting location until each of the winners of the selected low hand betting location has been paid.

23. The method of claim 8 wherein the first high hand betting location comprises a plurality of first high hand betting locations, each of the plurality of first high hand betting locations corresponding to one of the players, and wherein the first low hand betting location comprises a plurality of first low hand betting locations, each of the plurality of first low hand betting locations corresponding to one of the players.

* * * * *